United States Patent [19]

Kankaanpaa

[11] 4,209,361

[45] Jun. 24, 1980

[54] METHOD OF MULTI-NIP PRESSING IN A PAPER MACHINE

[75] Inventor: Matti Kankaanpaa, Tapiola, Finland

[73] Assignee: Valmet Oy, Finland

[21] Appl. No.: 790,209

[22] Filed: Apr. 25, 1977

Related U.S. Application Data

[62] Division of Ser. No. 310,805, Nov. 30, 1972, abandoned.

[51] Int. Cl.[2] ..... D21F 3/04

[52] U.S. Cl. ..... 162/205; 162/305; 162/360 R

[58] Field of Search ..... 100/121, 158, 162, 170, 100/176; 162/191, 205, 264, 305, 306, 358, 360 R

[56] References Cited

U.S. PATENT DOCUMENTS

| | | | |
|---|---|---|---|
| 2,204,426 | 6/1940 | Millspaugh | 162/305 |
| 2,686,463 | 8/1954 | Hornbostel | 162/191 |
| 2,764,068 | 9/1956 | Sutherest | 162/264 |
| 3,268,390 | 8/1966 | Ely, Sr. | 162/358 X |
| 3,826,713 | 7/1974 | Nykopp | 162/205 |
| 3,861,996 | 1/1975 | Dorfel | 162/360 R X |
| 4,075,056 | 2/1978 | Ely et al. | 162/305 |
| 4,086,131 | 4/1978 | Rempel et al. | 162/205 X |

FOREIGN PATENT DOCUMENTS

| | | | |
|---|---|---|---|
| 699107 | 12/1964 | Canada | 162/360 R |
| 382539 | 11/1964 | Switzerland . | |

OTHER PUBLICATIONS

Kenneth W. Britt, *Handbook of Pulp and Paper Technology*, Second Edition, 1970, pp. 419–426.

Albany International Corp., *Paper Machine Felts and Fabrics*, 1976, pp. 75–78.

*Primary Examiner*—Richard V. Fisher

*Attorney, Agent, or Firm*—Steinberg and Blake

[57] ABSTRACT

A method in a paper machine press section for dewatering a wet paper web by threading the web in an improved way and avoiding crushing or stretching the web structure through at least three nips of the press section. The invention is particularly characterized by following features of dewatering steps. The web while passing the press section through said three nips is all the time adhered to and supported by the surface of a felt or a roll without any open draws therebetween. Pressing the web in the first dewatering nip takes place between two felts and so the web is dewatered simultaneously through both sides of the web. Further dewatering and pressing steps take place in press nips which all are formed against a plain roll having a large diameter which enables a spacious location of the press rolls and their felts. Detaching the web from the surface of said plain roll for conducting the web into dryer section, takes place in a point allowing easy removal and handling of broke in case of a web break.

4 Claims, 2 Drawing Figures

METHOD OF MULTI-NIP PRESSING IN A PAPER MACHINE

This is a division of application Ser. No. 310,805, filed Nov. 30, 1972, now abandoned.

The present invention concerns a method for dewatering a paper web which is conducted through a multi-roller press assembly comprising at least three consecutive press nips defined by rolls interacting with each other and through which nips the continuous paper web coming from the wire section passes, being continually supported between the nips.

It is well-known that in the press assembly as much water as possible is removed from the paper web mechanically, whereupon the paper web is conducted into the drying section of the machine, where the rest of the water is removed from the paper web by evaporation. The most important and most serious problem in dewatering a web by pressing it between press rolls is that if one tries to remove water too efficiently and too rapidly, the fibre network in the paper web is not preserved well enough intact. In that case the natural strength of the web suffers, which has a negative effect both on the running of the paper machine and on the quality and other characteristics of the completed paper.

In press assemblies of prior art it also easily happens that, owing to conventional dewatering methods, the structural symmetry of the paper web cannot be preserved, which has a detrimental effect on the quality of the completed paper. The dewatering taking place in the first press nip of the press assembly has a decisive effect as regards the characteristics of the paper that is manufactured. Prior to entry into the press treatment, the paper web contains water about 4 to 6 times the amount of fibres found in it. When the web, containing a relatively great amount of water, is pressed, part of the fibres in the web tend to move along with the escaping water, thus suffering a displacement. The original fibre and material distribution in the paper web may even substantially change if dewatering in the press nip takes place in one direction only, through one face of the paper web. This is in fact what occurs in conventional press nips, where one surface of the paper web is opposed by a smooth roll surface and the other surface is towards a felt, under which there is e.g. a foraminous or grooved roll surface.

The present invention aims at improvement as regards the problems of paper technology introduced by the dewatering process as well as at developing the design of a pressing method and the press assembly with a view to improving the efficiency in operation of the paper machine. The starting point consisted of the consideration that, although dewatering is efficiently accomplished, the fibre network of the paper web should remain intact and structurally symmetrical. The passage of the paper web through the press assembly should be accomplished without subjecting the paper web to unnecessary stretching or other stress.

One of the characteristic features of the invention is that the paper web has been arranged to pass through the first press nip enclosed between two felts and that both rolls used to define this press nip are rolls which efficiently remove water. The concept of a "roll efficiently removing water" or a "water receiving roll" is here understood to be a general name for such rolls which have on their surface suitable cavities, holes or grooves, which promote the escape of water expressed from the paper web at the press nip. The commonest roll appropriate for this purpose is the foraminous suction roll and which has been connected to a vacuum system. The most recent development in such rolls with surfaces having cavities is represented by a roll type coated with a special coating, as disclosed in the U.S. Pat. No. 3,718,959, in which roll type, owing to the particular manufacturing process, the cross sectional shape of its groove-like cavities may be chosen almost arbitrarily and the volume of the grooves can be made greater than in conventional grooved rolls having grooves of the same width. The greater the volume of the cavities, the greater is the amount and efficiency with which water can be expressed from the paper web in the respective press nip.

When a roll efficiently removing water, of any type or of the kind described, is disposed on both sides of the press nip, such an arrangement means in principle that dewatering takes place through both surfaces of the paper simultaneously and symmetrically. When the web passes horizontally through the press nip, gravity tends to produce the effect that a greater part of the water expressed from the paper web may escape through the lower felt, compared to that removed through the upper felt. This can be prevented by selecting for the lower felt a felt type of greater density than for the upper felt. It is also possible to provide in the press nip in question a lower roll having a more closed surface structure than the upper roll or which is of another type. Most appropriately the upper roll is a suction roll. By this means the desired symmetric dewatering is ensured, which is important in view of preserving the structural symmetry of the paper web.

Especially in high-speed paper machines, the press assembly is required to have several press nips in order to acheive the highest possible efficiency of total dewatering in the press section. After dewatering has been accomplished in the first press nip symmetrically under the conditions described above, the structure of the paper has usually already been consolidated sufficiently to enable, as a rule, the dewatering in subsequent press nips to take place unilaterally without risk of any detrimental changes in the fibre structure of the paper web. Of course, this depends on the composition of the paper web and on the characteristics and dimensions of its fibres. A web having a highly homogeneous composition and which contains a great amount of long fibres and virtually no fillers, permits dewatering in one direction only in subsequent steps.

When the aim is to design a press assembly and to develop a pressing method having the characteristics of highest possible compactness, small space requirements and best performance as regards the reliability in operation of the paper machine, the path of the paper web through the press assembly should be designed so that the paper web proceeds between consecutive press nips supported either by press felts or by press rolls as far as possible. In a press assembly designed for applying the method in accordance with the present invention it is in fact possible, on the side of improvements relating to paper technology, to achieve such a closed threading or conduction of the web which is highly advantageous in view of the runnability of the paper machine and which improves the running efficiency of the machine. In this case it is not always possible in the press nips following after the first one to apply the symmetric dewatering principle; instead, these press nips have to be designed for unilateral dewatering. But, as has been said, this solution is not objectionable except in the case of very few paper grades.

In addition to the above-mentioned characteristic concerning the most important first dewatering step, it is a characteristic feature of the invention in view of improved reliability in operation of the press assembly that for the purpose of forming the following press nips after the first press nip the press assembly comprises a roll with plain smooth surface provided with a doctor means, which roll has a diameter substantially, at least 10 per cent, greater than the larger of the rolls defining the first nip and which smooth surfaced roll is urged against the upper roll of the two rolls belonging to the first nip so that thus the second press nip of the press assembly is formed at a point at a distance equivalent to an arc of 90 to 150 degrees from the first nip, this arc distance being measured along the periphery of said efficiently dewatering upper roll.

The large diameter of the smooth surfaced roll enables additional press nips to be formed in the press assembly, for the purpose of boosting its action, after said second nip so that between each two of these nips the paper web proceeds through the press assembly, being supported by the surface of said smooth roll all the time. The large diameter of said plain roll allows also a proper position for the doctor means to enable an easy removal of the broke into the broke pit just beneath the plain roll.

The third nip of the system is accomplished by urging a third efficiently dewatering roll, disposed within a felt loop of its own, against said smooth surfaced roll at a point at 70 to 160 degrees arc distance from the second nip, measured along the periphery of the smooth surfaced roll.

It is furthermore possible to provide in the press assembly also a fourth press nip at a point having a distance of about 70 to 160 degrees from the third nip, again measured along the periphery of the smooth surfaced roll.

The mutual distances of the press nips are mainly dependent on the framework of the press assembly. The large diameter smooth-surfaced roll, which is the mating roll in the second, third and fourth nip, can be carried on a lever arm having its pivotal point in the frame portion over said roll, so that the lever arm is oriented with reference to the vertical most usually at an angle of 25 to 40 degrees in the direction of the entering or leaving paper web. When the lever arm has an inclined position pointing towards the direction of the entering paper web, the second and third nip have to be spaced far apart, corresponding to about 120 to 160 degrees of arc, while the distance between the third and fourth nip is about 70 to 120 degrees in this case. If in turn, the lever arm is inclined, pointing in the direction of the leaving paper web, the corresponding may be distances are:

between the second and third nip 70 to 120 degrees, between the third and fourth nip 120 to 160 degrees.

As further regards the fourth nip, it is possible to place at this point, depending on the paper grade to be manufactured and on the running conditions of the paper machine, either a further smooth roll or a fourth efficiently dewatering roll. If it is desired that the fourth nip acts only as a so-called equalizing press, a smooth roll without felt is used. If, on the other hand, it is necessary still to proceed with the dewatering at this stage, an efficiently dewatering roll is employed, which operates within a felt loop of its own.

The invention is described in greater detail in the following with reference to the attached schematic principle drawing, in which a couple of embodiment examples of the invention are presented.

Figure 1:
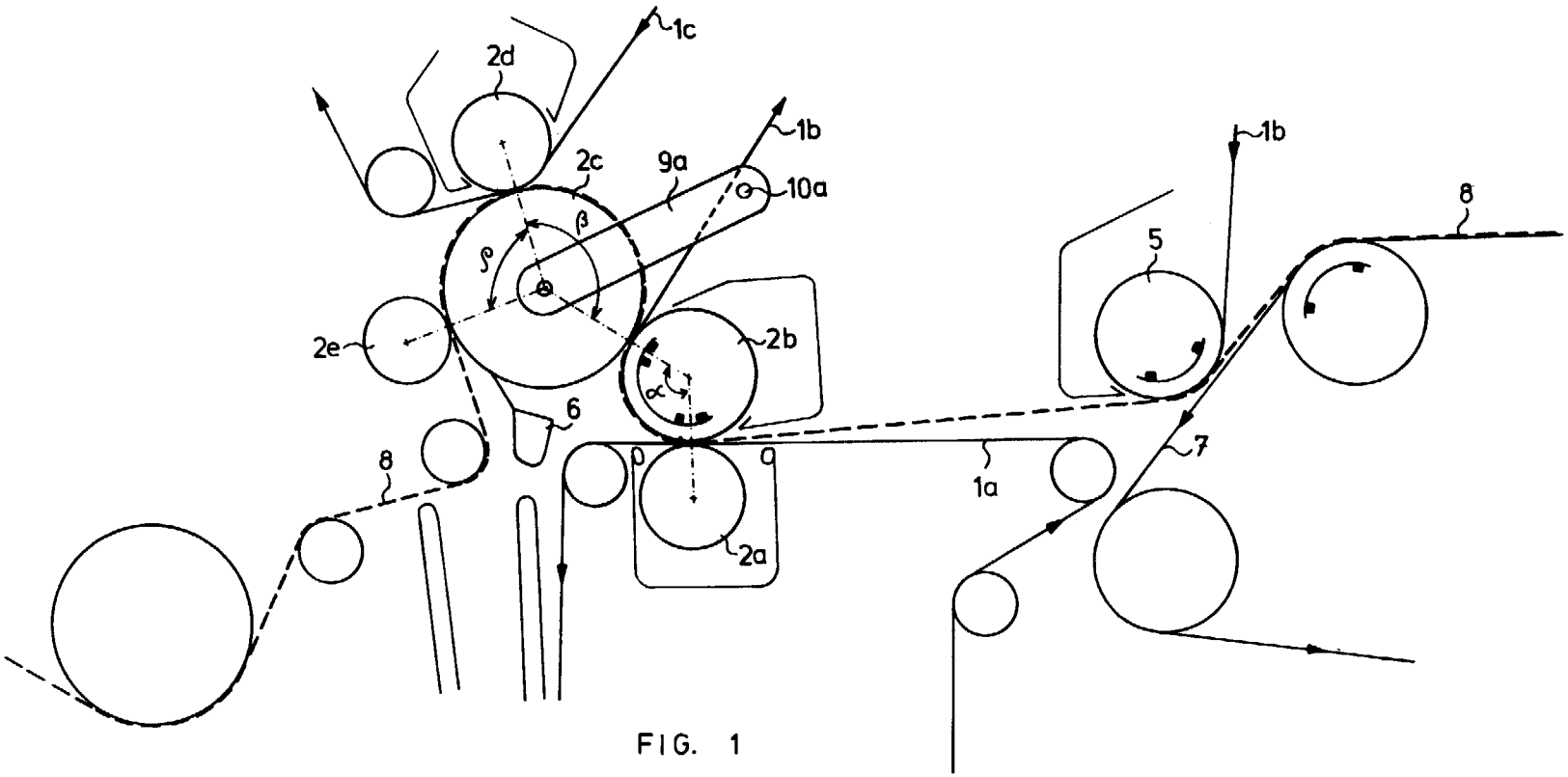
FIG. 1 shows schematically, in elevational view, a paper machine press assembly in which the method according to the invention is applied.

In the embodiment of FIG. 1, the paper web 8 is taken off the wire 7 by the aid of a pick-up suction roll 5, whereby the paper web 8 is transferred in so-called closed run onto the first felt 1*b* passing over the roll 5 and arrives, adhered to this first felt, without any support from below at the first press nip, which is defined by a first roll 2*b* and a second roll 2*a*. Through this press nip 2*a*/2*b* passes also the second felt 1*a*, whereby the paper web travels through the nip enclosed between two felts. The first felt and the second felt do not have a common run substantially before the first nip. The rolls 2*a* and 2*b* are both efficiently dewatering rolls having cavities in their surface. Roll 2*b* is preferably a suction roll, 2*a* a grooved roll. After the first press nip, the paper web 8 travels in a closed run, that is attached by suction to the felt 1*b*, to the second press nip 2*b*/2*c*. The roll 2*c* is a smooth-surfaced roll and has been fitted with a doctor device 6; of course, there may be more than one doctor. The walls 11 of a broke pit 12 are situated just underneath the plain-press roll 2*c* in case of a web break occurring after the web leaves the plain press roll surface. In such an instance, the full width of the web is led immediately into broke pit 12 by means of the doctor device 6 which contacts the plain roll surface on a downward open sector between the last press nip and the first press nip and detaches the web from the plain-press surface. At the press nip 2*c*/2*b*, dewatering takes place through the upper surface of the paper web, that is in the direction towards the roll 2*b*. From the second press nip, the paper web goes over to the surface of the roll 2*c* and thence further to the third press nip 2*c*/2*d*, formed by said plain roll 2*c* and an efficiently dewatering roll 2*d*, through which also a third felt 1*c* passes. At this press nip, dewatering takes place equally as in the second press nip, that is through the upper surface of the paper facing the third felt web. The angle indicated by $\alpha$ in the drawing is within the range of 90 to 150 degrees and that marked $\beta$ is between 70 and 160 degrees.

From the third press nip the paper web may be conventionally conducted into the drying section. However, in the embodiment of FIG. 1 the press assembly furthermore comprises a roll 2*e*, which together with the roll 2*c* defines a so-called equalizing press nip. The roll 2*e* may be disposed at an angular distance $\rho = 70$ to 160 degrees from the press nip 2*c*/2*d*.

Figure 2:
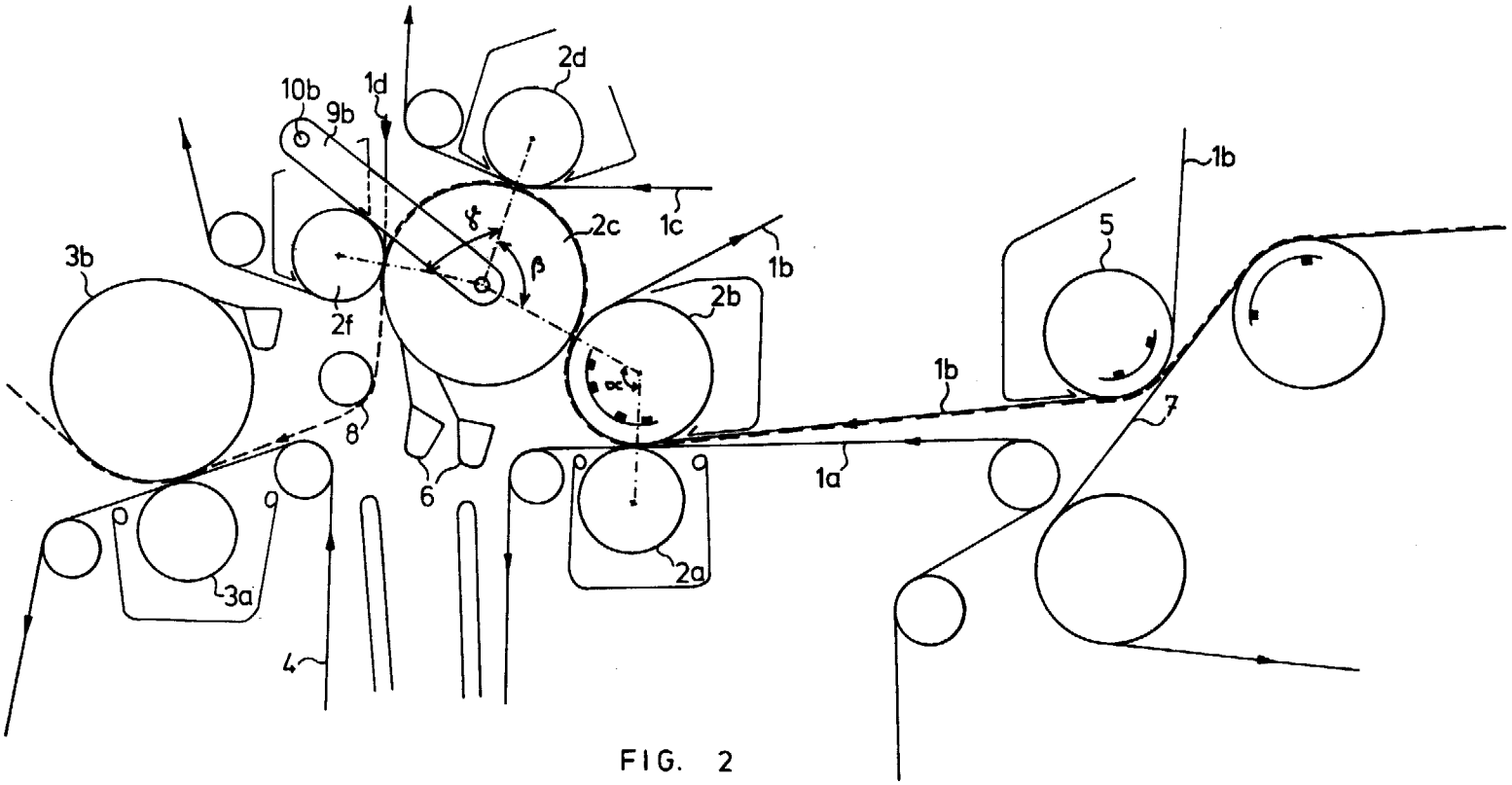
FIG. 2 shows schematically, in elevational view, another embodiment of a paper machine press assembly for applying the invention.

The embodiment of FIG. 2 is, up to the third press nip 2*c*/2*d*, substantially similar to that shown in FIG. 1. In FIG. 2 there has been shown, instead of the roll 2*e* of FIG. 1, a fourth efficiently dewatering roll 2*f* placed so as to be contiguous with the smooth surfaced roll 2*c*. Roll 2*f* is disposed within a felt loop 1*d* of its own. The rolls 2*c* and 2*f* define in the press arrangement a fourth press nip 2*c*/2*f*, having a distance from the third press nip 2*c*/2*d* of the press assembly equivalent with the arc indicated by $\gamma$. The $\gamma$ may be within the range of 70 to 160 degrees.

According to FIG. 2, the paper web is conducted, after the fourth press nip 2c/2f, into the nip 3a/3b defined by the pair of rolls 3a, 3b. This pair of rolls comprises an efficiently dewatering roll 3a within a felt loop 4 of its own, and a smooth roll 3b. In the nip 3a/3b, dewatering takes place, with reference to the plane of the web 8, in the direction opposite to that in the fourth, third and second nips preceding this nip 3a/3b.

As regards, in practice, the designs of the efficiently dewatering different rolls 2a, 2b, 2d and 2f, these rolls may be, for instance, of following kinds:

The roll 2a may be a suction roll, or a recessed surface roll (grooved roll, blind role drilled roll, roll with plastic wire covering, etc). If a recessed surface roll, it may be a flexible or flexure-compensated roll, or a completely normal roll.

The roll 2b is preferably a suction roll provided with one or several suction zones, but a recessed surface roll in general may be also used.

For the rolls 2d and 2f similar structures can be considered as for the roll 2a. Most suitable are grooved rolls.

Roll 2c as well as roll 2e may be rolls having a smooth and hard or soft surface.

It is understood that the invention is in no way narrowly confined to the embodiment examples presented in the foregoing. Various details in the design of a paper machine press assembly according to the invention may be altered, modified and combined in many different ways without departing from the idea of the invention. It should be realized that the arrangement of nips implied by the invention is achievable by a great number of different arrangements of rolls and felts.

I claim:

1. A method of paper machine press section for dewatering a wet paper web by passing the web while avoiding its stretching through at least three nips of the press section which nips dewater the web, the web being at all times supported by the surface of a felt or a roll, comprising the following steps:

detaching the web from a paper machine forming wire by means of a first felt loop and pick-up suction roll operating within said first felt loop and adhering the web onto the lower surface of said first felt loop;

transferring the web adherent to the lower surface of said first felt loop and without any substantial support from below to the first dewatering press nip of the press section, which nip is formed by and between a first water-receiving roll which is a suction roll and a second water-receiving roll;

passing a second felt loop into the first dewatering press nip in such a way that said second felt comes into contact with the web only in the area of said first nip;

pressing the web in the first dewatering press nip between the first felt and the second felt and thus dewatering the web simultaneously in two directions through both sides of the web;

detaching the web from the second felt;

adhering the web by suction on the first felt, wrapping the first water-receiving roll on a sector following the first nip;

transferring the web to a second dewatering press nip formed by the first water-receiving roll and by a smooth surface plain roll;

pressing the web in said second nip so as to dewater the web through its one side facing the first felt;

detaching the web from the first felt and adhering the web onto the surface of said plain-press roll;

transferring the web adhered on the surface of said plain-press roll, to a third dewatering nip formed by said plain-press roll and a fourth press roll, which fourth roll is a water-receiving roll;

passing a third felt into said third dewatering nip and pressing the web in said third dewatering press nip so as to dewater the web through its one side facing the third felt;

transferring the web being continuously, beginning from the second nip, adhered to the surface of said plain-press roll after said third nip to a following web processing step comprising the step of smoothing the web in a fourth nip formed by said smooth surface plain roll and a further plain-press roll with a soft covering.

2. The method according to claim 1, wherein the travel of the web on said plain-roll surface from a third nip to said fourth nip corresponds to a central angle of 70–160 degrees of the plain-press roll.

3. A method in a paper machine press section for dewatering a wet paper web by passing the web while avoiding its stretching through at least three nips of the press section which nips dewater the web, the web being at all times supported by the surface of a felt or a roll, comprising the following steps:

detaching the web from a paper machine forming wire by means of a first felt loop and pick-up suction roll operating with said first felt loop and adhering the web onto the lower surface of said first felt loop;

transferring the web adherent to the lower surface of said first felt loop and without any substantial support from below to the first dewatering press nip of the press section, which nip is formed by and between a first water-receiving roll which is a suction roll and a second water-receiving roll;

passing a second felt loop into the first dewatering press nip in such a way that said second felt comes into contact with the web only in the area of said first nip;

pressing the web in the first dewatering press nip between the first felt and the second felt and thus dewatering the web simultaneously in two directions through both sides of the web;

detaching the web from the second felt;

adhering the web by suction on the first felt, wrapping the first water-receiving roll on a sector following the first nip;

transferring the web to a second dewatering press nip formed by the first water-receiving roll and by a smooth surface plain roll;

pressing the web in said second nip so as to dewater the web through its one side facing the first felt;

detaching the web from the first felt and adhering the web onto the surface of said plain-press roll;

transferring the web adhered on the surface of said plain-press roll, to a third dewatering nip formed by said plain-press roll and a fourth press roll, which fourth roll is a water-receiving roll;

passing a third felt into said third dewatering nip and pressing the web in said third dewatering press nip so as to dewater the web through its one side facing the third felt; and transferring the web being continuously, beginning from the second nip, adhered to the surface of said plain-press roll after said third nip to a following web processing step comprising the step of dewatering the web in a fourth press nip formed by said smooth surface plain roll and a further water-receiving roll inside a fourth felt loop.

4. The method according to claim 3, wherein the travel of the web on said plain-roll surface from third nip to said fourth nip corresponds to a central angle of 70–160 degrees of the plain-press roll.

* * * * *